US005662126A

United States Patent [19]

Charlton et al.

[11] Patent Number: 5,662,126

[45] Date of Patent: Sep. 2, 1997

[54] SMOKE FILTER CONTAINING PARTICULATE SMOKE MODIFYING ADDITIVE

[75] Inventors: John Charlton, Glebe; Paul Francis Clarke, South Shields, both of United Kingdom

[73] Assignee: Cigarette Components Limited, Slough, United Kingdom

[21] Appl. No.: 739,732

[22] Filed: Nov. 7, 1996

Related U.S. Application Data

[63] Continuation of Ser. No. 259,121, Jun. 10, 1994, abandoned, which is a continuation of Ser. No. 791,954, Nov. 13, 1991, abandoned.

[30] Foreign Application Priority Data

Nov. 19, 1990 [GB] United Kingdom ..... 9025062
Oct. 14, 1991 [GB] United Kingdom ..... 9121787

[51] Int. Cl.[6] ..... A24D 1/02; A24D 1/04; A24D 3/00

[52] U.S. Cl. ..... 131/342; 131/365

[58] Field of Search ..... 131/331, 342, 131/335, 362, 365; 55/522

[56] References Cited

U.S. PATENT DOCUMENTS

| | | | |
|---|---|---|---|
| 3,319,630 | 5/1967 | Ormins | 131/342 X |
| 5,404,890 | 4/1995 | Gentry et al. | 131/342 |

FOREIGN PATENT DOCUMENTS

| | | | |
|---|---|---|---|
| 562271 | 8/1958 | Canada | 131/342 |
| 871487 | 5/1971 | Canada . | |
| 437599 | 10/1935 | United Kingdom . | |
| 476746 | 12/1937 | United Kingdom . | |
| 739259 | 10/1955 | United Kingdom . | |
| 741429 | 12/1955 | United Kingdom . | |
| 823690 | 11/1959 | United Kingdom . | |
| 1023918 | 3/1966 | United Kingdom . | |
| 1045826 | 10/1966 | United Kingdom . | |
| 1096113 | 12/1967 | United Kingdom . | |
| 1121474 | 7/1968 | United Kingdom . | |
| 1449031 | 9/1976 | United Kingdom . | |
| 2223393 | 4/1990 | United Kingdom . | |
| 2229078 | 9/1990 | United Kingdom . | |
| 2236239 | 4/1991 | United Kingdom . | |

*Primary Examiner*—Jennifer Bahr
*Attorney, Agent, or Firm*—Scully, Scott, Murphy & Presser

[57] ABSTRACT

A filter having a longitudinal axis and having a tube formed by at least one strip [2] which is pre-coated with particulate smoke modifying additive [4] adhering thereto and which curves through at least 360° about the longitudinal axis.

3 Claims, 2 Drawing Sheets

SMOKE FILTER CONTAINING PARTICULATE SMOKE MODIFYING ADDITIVE

This application is a continuation of application Ser. No. 08/259,121, filed Jun. 10, 1994, now abandoned, which was a continuation of application Ser. No. 07/791,954, filed Nov. 13, 1991, now abandoned.

BACKGROUND OF THE INVENTION

The present invention concerns filters and filter elements (suitable but not necessarily for tobacco smoke filters) containing particulate smoke-modifying additive.

Suitable particulate additives include sorbents (e.g. selected from activated carbon, silica gel, sepiolite, alumina, ion exchange material etc.), pH modifiers (e.g. alkaline materials such as $Na_2CO_3$, acidic materials), flavourants, other solid additives and mixtures thereof.

The various prior procedures for manufacturing such filters have suffered from one or more of production problems, problems of control over product quality and uniformity, and problems of machinery wear.

SUMMARY OF THE INVENTION

The present invention provides a filter or filter element having a longitudinal axis and comprising a tube formed by at least one strip which is pre-coated with particulate additive adhering thereto and which curves through at least 360° about said longitudinal axis.

A plurality of superposed such pre-coated strips may each curve through 360° or more to form the tube. In one type of embodiment, the pre-coated curved strip (or strips) is (or are) held in tubular form around a central core.

In each type of embodiment, any said strip may be pre-coated on both faces or on any one face with the adhering particulate smoke modifying additive.

The substrate strip(s) may have the additive particles individually adhered directly thereto. Another possibility is for additive particles to be first adhered to threads, with the coated threads then being adhered to the strip(s)—e.g. with the coated threads parallel and in side-by-side contact.

Where two or more of the pre-coated strips are present, any two may be in facial contact (strip-to-strip, strip-to-coating, or coating-to-coating) or separated by intervening material.

The particulate additive is suitably adhered to said strip(s) by hot melt adhesive, high m.p. polyethylene glycol, or emulsion-type adhesive such as PVA. Suitable hot-melt adhesives for use in the invention are various polyester adhesives. Any particulate additive used may be a single substance or a mixture, and may be in admixture with other material. Where there are two or more of the strips, different strips may carry different additives. Where a strip has particulate additive adhered to both faces, different particulate additives may be used for the two faces.

The particulate additive adhered to a face of a said strip need not cover the whole area of this face.

Where the filter or element has a tube of said pre-coated strip(s) around a core, the core could be of conventional smoke filtering material (e.g. of filamentary tow, staple fibre, or creped paper); an open ended tube; or an impermeable or low-permeability portion which contributes to the composite filter pressure drop but has little or no filtering effect; the core could be a unitary body, or it could be a composite—e.g. incorporating its own wrapper and/or having longitudinally (and/or radially) adjacent portions. In one type of embodiment having a said tube around a core, particulate smoke-modifying additive is adhered to the inner face of the tube around the core; the tube could itself be surrounded by an outer annular body—which, like the core, could for example be of conventional smoke filtering material or an impermeable or low-permeability portion with little or no filtering effect.

Filters and elements according to the invention may have a containing sleeve e.g. an extruded sleeve or a plugwrap with a lapped and stuck seam; such a plugwrap could be of air-permeable or -impermeable material, and in either case may be perforated. If the particulate coating on the strip(s) is itself coated with adhesive (e.g. heat-activatable adhesive) then bonding can be effected or initiated as the tube is formed, to give a bonded tube which is dimensionally stable without a containing sleeve; the adhesive coating might need to be discontinuous (e.g. a powder coating) so as not to interfere unduly with the smoke modifying properties of the particulate additive. In another arrangement, a strip edge without particulate coating may carry adhesive and be used as an adhesive overlap to hold the curved strip in tube form. However, even with bonding of the pre-coated strip(s), it may be preferred to provide a containing sleeve for the tube.

The preformed particulate additive-coated strip(s) is or are conveniently converted to tube form using conventional garniture apparatus. In a method according to the invention the supply of the particulate additive-carrying strip(s), the formation thereof into a tube (usually with application of a surrounding sleeve), and cutting of the resulting elongate product into finite lengths, can be conducted continuously and in-line using conventional filter manufacturing machinery. To form a tube, the strip(s) may be gathered around a central mandrel. Where the tube is to have a core, the core may be advanced (or formed and advanced) continuously as the particulate additive-carrying strip(s) is or are wrapped around it; where the tube is itself to be surrounded by an outer annular body, the latter may be similarly continuously fed and formed around the advancing wrapped core; continuous in-line procedures and apparatus for these operations are known in the cigarette filter art.

The strip(s) may be coated with adhesive (e.g. by drawing through a bath or other supply of the active adhesive) and then with particulate additive (e.g. by drawing through a reservoir, fluidised bed, circulated stream or other supply of the additive whilst the adhesive is active) as part of the above in-line continuous process; instead adhesive-coated strip(s) may be separately produced or obtained from an outside supplier, with activation (e.g. heat-softening) of the adhesive and application of particulate additive being conducted in-line and continuously with filter production. Uniform application of adhesive (e.g. from a bath of PVA liquid) may be ensured by doctoring, e.g. through a slot or past or between a blade or blades. The loading of particulate additive onto an adhesive coated strip may be the maximum possible, this depending on factors such as particle size, strip width, etc. The additive loading per strip may however vary widely, as may the total loading when two or more substrate strips are used, according to product requirements. Heavy loading of the strips can give elements which consist substantially wholly of particulate additive, without the disadvantages of the prior types of particulate filter component and their production methods. Filters according to the invention may incorporate other material.

Other parameters may also vary widely according to product requirements, these including for example weight/unit length of the strip(s) used to carry the particulate additive, the particle size of the additive, etc. A suitable particle size for activated carbon is 12/30 British Standard Mesh, and another is 30/70 British Standard Mesh.

The strip(s) employed according to the invention may be of any innoxious material. A strip may be a textile material, e.g. a woven or non-woven ribbon, or cigarette filter plugwrap; it may be permeable or impermeable to smoke or air, according to the flow requirements in the final product.

At least some of the particulate additive used may carry (or consist of) flavourant—or other material carrying flavourant may be incorporated.

The invention permits incorporation of activated carbon or other particulate additive in tobacco smoke filters using conventional apparatus without introducing production or apparatus problems and in particular with ready achievement of uniform additive loading—and simple and accurate variation of this loading when required. Filters according to the invention allow the particulate additive adhered to the strip(s) to exercise, unhindered or substantially so, its filtering or other effect on the tobacco smoke stream; thus filters according to the invention containing particulate sorbent can give good retention of vapour phase smoke components.

Filters and elements according to the invention can be produced continuously and cut into finite lengths. Each individual such finite length could be used on its own as a filter for a cigarette, but is preferably employed in longitudinal alignment with at least one other filter element as part of a composite (e.g. dual or triple) cigarette filter having a common joining outer wrap which extends circumferentially fully or only partly around the composite filter and which could be permeable or impermeable to smoke or air. Preferably an individual filter element according to the invention is employed in conjunction with a longitudinally aligned buccal end element of conventional appearance—e.g. a uniform plug of cellulose acetate filamentary tow; the two elements could abut, or be spaced to provide an intervening cavity which could be air-ventilated and/or contain additive granules.

Products according to the invention are generally suitable for use as or in tobacco smoke filters, but whilst the invention has been described mainly in terms of such filters, it is not limited to this usage; it provides the defined products per se whatever their application or intended use. Cigarette filters according to the invention will usually be attached to the wrapped tobacco rods by conventional tipping overwrap, which may be ventilating or non-ventilating overwrap.

BRIEF DESCRIPTION OF THE DRAWINGS

Embodiments of the invention are illustrated, by way of example, in the accompanying drawings, wherein.

DETAILED DESCRIPTION OF THE PREFERRED EMBODIMENTS

Figure 1:
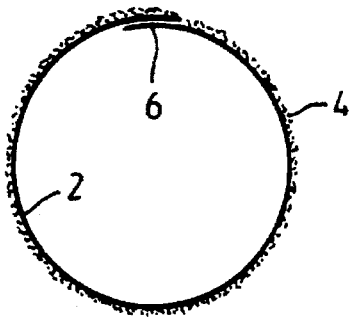
FIGS. 1–10 are schematic sectional views of respective different embodiments of the invention. In the drawings, like reference numerals indicate like parts.

FIG. 1 shows a tubular filter or filter element comprising a strip of plugwrap 2 pre-coated with activated carbon particles 4 adhered to one face and curved to form a tube with the particles 4 on its outer face. At 6 a particle-free but adhesive edge of the strip forms a stuck and lapped seam with the other edge of the strip so that the filter is held in tube form. In modifications the particles 4 could instead be on the other face of the strip 2 forming the inner surface of the tube, or particles 4 could be adhered to both faces of strip 2; other possible variations are that of the strip 2 being wrapped around a core, and/or the provision of a containing wrapper about the tubular structure.

Figure 2:
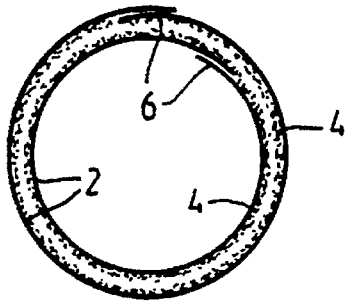

FIG. 2 shows a similar embodiment wherein a tube as shown in FIG. 1 has an outer layer formed by another strip of plugwrap 2 having particles 4 adhered thereto, this being wrapped around the innermost tube with the two particulate coatings 4 in contact, the outer layer likewise being held in tubular form by a particle-free lapped and stuck seam 6. Variations mentioned in connection with FIG. 1 can be applied also to FIG. 2.

Figure 3:
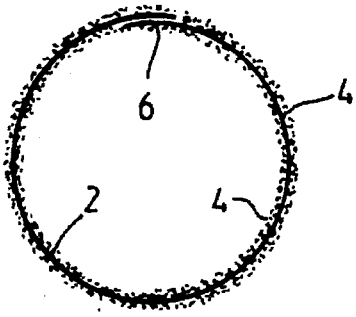

FIG. 3 shows a tubular filter or filter element formed from a strip of plugwrap 2 coated on both faces with absorbent particles 4 adhering thereto; one face of one edge and the opposite face of the other edge of strip 2 are particle-free but adherent so as to allow for a lapped and stuck seam 6 holding the product in tubular form. An additional layer or layers of strip 2 coated with particles 4 on one or both faces may be applied around the illustrated structure, and the other previously mentioned variations (provision of a core and/or containing outer wrap) are also possible.

Figure 4:
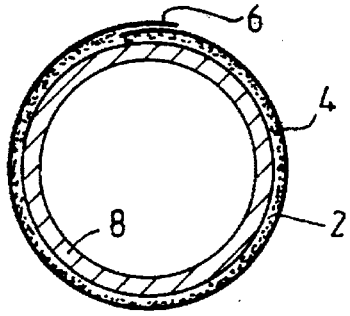

FIG. 4 shows a filter having a strip of plugwrap 2 coated with sorbent particles 4 adhering thereto wrapped around a tubular core 8 with the particles 4 against core 8, the coated strip 6 being secured as before with a particle-free lapped and stuck seam 6. Strip 2 could instead or additionally be coated with particles 4 on its other face, and one or more additional surrounding layers of strip 2 with adhering particles 4 could be provided.

Figure 5:
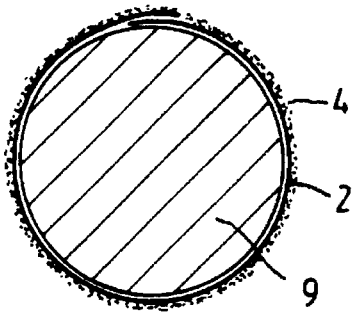

FIG. 5 shows a strip of plugwrap 2 coated on one face with sorbent particles 4 adhering thereto and wrapped around a conventional filter plug 9 with the particles 4 outermost. In this case the edges of strip 4 could be abutted together and they could be adhered to plug 9. Instead or in addition, the illustrated filter could be provided with a containing plugwrap. As in previous embodiments, particles 4 could be adhered to both faces of strip 2 and an additional layer or layers of strip 2 coated with particles 4 on one or both faces could be provided.

Figure 6:
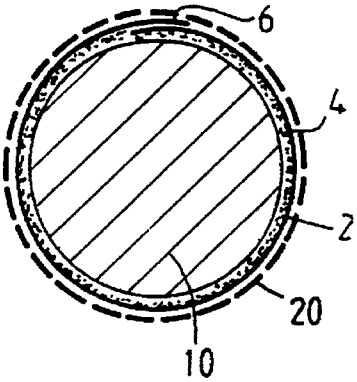

FIG. 6 shows an embodiment similar to that of FIG. 4 except that the core is a plug 10. The longituduinal edges of the pre-coated strip 2 could instead be butted together, in which case the coated strip might for example be held in tube form by being adhered to the core or by an outer wrapper; the adhering particles 4 could cover less of the face of strip 2—for example both longitudinal edges of the strip could be free of the additive particles where they form a lapped and stuck seam 6. The core 10 could be a conventional filter plug, as in FIG. 5, or an impermeable or low permeability plug which imparts pressure drop and has little or no filtering effect. The embodiment shown optionally has a containing wrap 20 which could be an extruded sleeve or a conventional plugwrap with a lapped and stuck seam.

Figure 7:
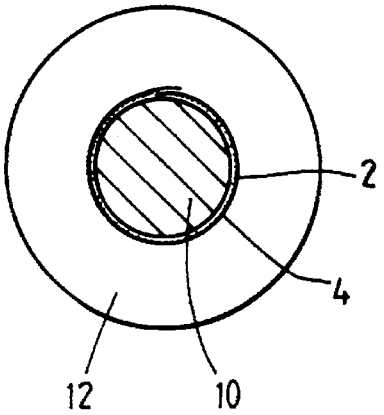

FIG. 7 shows a structure of the FIG. 6 type in which the composite of the core 10 and surrounding coated strip 2 is itself further surrounded by an annular body 12. In this case, the core 10 could for example be a filter plug of cellulose acetate tow, the strip 2 could be an impermeable plugwrap, the particulate additive adhered to the inner face of the strip could be activated carbon, and the outer annular body 12 could be another body of cellulose acetate tow in a highly porous outer wrap which allows a high degree of ventilation.

Figure 8:
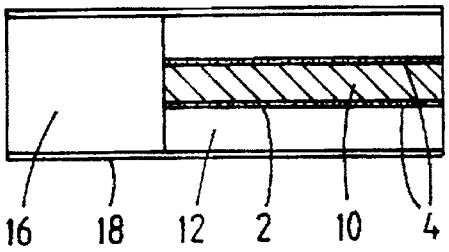

FIG. 8 illustrates (in longitudinal section rather than in cross section like all of the preceding Figures) a composite element of the FIG. 7 type combined into a dual filter with a filtering plug 16 of non-wrapped cellulose acetate tow in a common joining porous plugwrap 18. Such a dual filter according to the invention would be incorporated in a cigarette with the additive-containing element towards the tobacco rod and the non-wrapped acetate element exposed at the buccal end.

Figure 9:
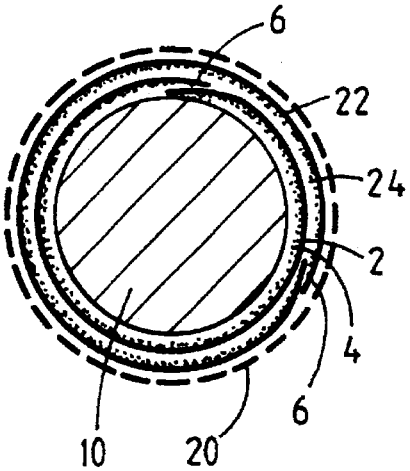

FIG. 9 illustrates in cross-section a filter or filter element of the FIG. 6 type but in which the additive-coated strip 2 has engaged therearound another strip of plugwrap similarly coated with particulate additive 24 and held in tubular form (e.g. by lapped and stuck seam 6) around strip 2 with additive 24 radially innermost. As in FIG. 6, an outer containing wrapper 20 is optionally provided as part of the composite product. Particulate additives 4 and 24 may be the same or different.

A similar embodiment could be provided by using around core 10 a strip 2 of the FIG. 3 type (coated on both faces with particulate additive adhering thereto) surrounded by a plain (particulate additive-free) plugwrap 22 and optionally by an outer containing wrap 20 as above.

Figure 10:
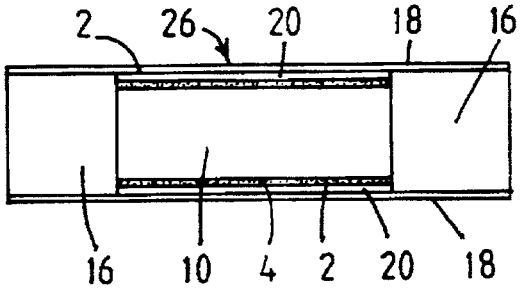

FIG. 10 illustrates in longitudinal section a composite element 26 of the FIG. 6 or 9 type combined into a triple filter with filtering plugs 16 of non-wrapped cellulose acetate tow (NWA) in a common joining plugwrap 18. The element 26 as shown has core 10 surrounded only by tubular strip 2 (with adhering particulate additive 4) and containing wrap 20 as in FIG. 6, but it could instead have the FIG. 9 structure with tubular strip 22 and additive particles 24 in addition. The FIG. 10 filter could be obtained from a continuously produced rod by forming a strip of end-to-end abutting elements consisting of elements 26 alternating with NWA elements of double the length shown at 16, continuously advancing this rod whilst wrapping it in common wrapper 18, and cutting the continuously produced rod through NWA segments; usually the rod would initially be cut into multiples of the individual filter length shown in FIG. 10 (e.g. double, quadruple or sextuple lengths), with final cutting to unit length being conducted subsequently as part of filter cigarette production. A similar procedure could be used for the FIG. 8 embodiment—e.g. with initial cutting through the composite elements to give multiple length rods and then through the inboard elements to eventually give the unit lengths on filter cigarette assembly. The multiple length rods are according to the invention.

In the following Examples, all pressure drops are measured "totally enclosed"—i.e. with the cylindrical surface of the test item surrounded by an impervious sleeve so that there is no flow across it. Herein, all mesh sizes are British Standard.

EXAMPLE 1

Filters were made of the type shown in FIG. 10.

The NWA elements 16 were of 1.5/38 denier tow, each 5 mm long by 22.75 mm circumference, and with a combined pressure drop (PD) of 83 mm water guage (Wg).

Composite element 26 was 10 mm long by 22.1 mm circumference, and had a core 10 of 2.1/30 denier cellulose acetate tow. Strip 2 was of non-porous plugwrap and 23 mm wide, with particles 4 of activated carbon (18/40 British Standard Mesh) at a loading of 5.4 mg/mm length adhered thereto (as shown in FIG. 6) with PVA adhesive. Containing outer wrap 20 was a 25 mm wide plugwrap having a porosity of 5000 Coresta units. The pressure drop of element 26 was 23 mm.Wg.

In the triple filter, elements 16 and 26 were combined as shown in FIG. 10 by plugwrap 18 (also of porosity 5000 Coresta units), elements 16 being slightly compressed thereby. The triple filter was 20 mm long by 22.46 mm circumference and had a pressure drop of 106 mm.Wg. and a carbon content of 54 mg.

These triple filters were attached to commercial cigarette rods by permeable tipping overwrap. The resulting cigarettes when test smoked in accordance with the standard ISO/Coresta methods gave tar retention of 55.2% and nicotine retention of 44.8% and the following vapour phase retentions:

| | % |
|---|---|
| Methanol | 17.5 |
| Acetaldehyde | 4.8 |
| Acetonitrile | 21.8 |
| Acrolein | 15.0 |
| Acetone | 16.9 |
| Isoprene | 18.3 |
| Butadione | 38.0 |
| Butanone | 29.9 |
| Benzene | 28.2 |
| Toluene | 42.2 |

EXAMPLES A TO L

In Examples A to J and L, Example 1 was repeated using various particulate additives and with other modifications as indicated below. In Example K there was the further modification that element 26 was of the FIG. 9 type.

The triple filters used 6 mm long NWA elements and a 12 mm long element 26 (termed "ACS" below) in common plugwrap 18 of substance 27 g/m$^2$. The NWA elements were of 1.6/48 denier tow with a normal circumference of 24.8 mm.

In ACS element 26, Examples A to L used 8/39 denier cellulose acetate tow for core 10, and 27 mm wide plugwrap (of porosity about 7,500 Coresta units) for strip 2 with various particulate additives 4 adhered thereto as in Example 1. Containing wrap 20 was of standard 27 g/m$^2$ plugwrap.

Other details of the ACS elements 26 and triple filters are given in the following Table. In the "Additive" column, "C" stands for activated carbon and the numerals for mesh size—e.g. "C 12/22" means activated carbon of 12/22 British Standard mesh size. The mixed particulate additive of Examples F and G contained a 2:1 weight ratio of 12/22 mesh activated carbon and 15/30 mesh sepiolite. In Example K, a strip 2 carrying 30/70 mesh activated carbon on its inner face was immediately surrounded, as illustrated in FIG. 9, by another strip 22 having sepiolite 24 similarly adhered to its inner face, the latter in turn having containing wrap 20 around it.

In modifications of the embodiments of FIG. 10 and Examples 1 and A to L, the containing wrap 20 can be omitted, with element 26 still being made of a size to engage with joining wrap 18.

| | ELEMENT 26 (ACS) | | | TRIPLE FILTER | | | |
|---|---|---|---|---|---|---|---|
| | Additive | | Mean | Mean | Mean PD | | Additive |
| | Type | mg/mm | Circumference mm | Circumference mm | Tip | Elements NWA + ACS + NWA | mg/Tip |
| A | Sepiolite | 7.13 | 24.30 | 24.55 | 94 | 33 + 25 + 33 | 86 |
| B | Sepiolite | 4.87 | 24.35 | 24.41 | 89 | 34 + 18 + 34 | 58 |
| C | C 12/22 | 8.9 | 24.03 | 24.44 | 103 | 42 + 24 + 30 | 107 |
| D | C 30/70 | 3.39 | 24.14 | 24.38 | 101 | 39 + 21 + 38 | 41 |
| E | C 30/70 | 2.25 | 23.75 | 24.27 | 100 | 36 + 22 + 36 | 27 |
| F | C + Sepiolite | 8.84 | 24.16 | 24.49 | 111 | 37 + 27 + 36 | 106 |
| G | C + Sepiolite | 4.99 | 23.88 | 24.29 | 100 | 39 + 16 + 42 | 60 |
| H | C 12/22 | 7.22 | 24.08 | 24.44 | 105 | 37 + 24 + 39 | 87 |
| I | C 12/22 | 5.64 | 23.91 | 24.36 | 101 | 39 + 19 + 35 | 68 |
| J | C 30/70 | 3.39 | 24.13 | 24.26 | 112 | 40 + 27 + 40 | 41 |
| K | C 30/70 + Sepiolite | 4.86 | 24.35 | 24.43 | 96 | 38 + 12 + 40 | 58 |
| L | C 30/70 | 2.58 | 23.77 | — | — | — | — |

We claim:

1. A tobacco smoke filter, comprising a tubular element having an inner and outer face and containing, coated on at least one of said faces, a particulate smoke-modifying sorbent additive adhering thereto, wherein said tubular element surrounds a core and comprises a sheet which is adhesively secured at an abutted or slightly lapped longitudinal seam.

2. The tobacco smoke filter of claim 1 wherein said smoke-modifying sorbent additive is adhered to both faces of said tubular element.

3. The tobacco smoke filter of claim 1 wherein said smoke-modifying sorbent additive is adhered to the inner face of the tubular element.

* * * * *